US007249424B2

(12) United States Patent
Lipponen et al.

(10) Patent No.: US 7,249,424 B2
(45) Date of Patent: Jul. 31, 2007

(54) METHOD AND DEVICE FOR CONTROLLING THE MOISTURE OR COATING QUANTITY PROFILE IN A PAPER WEB

(75) Inventors: Juha Lipponen, Järvenpää (FI); Hans Sundqvist, Turku (FI); Jarkko Nurmi, Turku (FI); Jarkko Veijola, Turku (FI); Jari Almi, Pirkkala (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/432,584

(22) PCT Filed: Nov. 22, 2001

(86) PCT No.: PCT/FI01/01014

§ 371 (c)(1),
(2), (4) Date: Nov. 10, 2003

(87) PCT Pub. No.: WO02/42555

PCT Pub. Date: May 30, 2002

(65) Prior Publication Data

US 2006/0225303 A1 Oct. 12, 2006

(30) Foreign Application Priority Data

Nov. 24, 2000 (FI) ..... 20002592

(51) Int. Cl.
*F26B 3/00* (2006.01)

(52) U.S. Cl. ..... 34/446; 34/119; 162/198; 73/38

(58) Field of Classification Search ..... 34/381, 34/445, 446, 108, 110, 114, 115, 116, 119
See application file for complete search history.

(56) References Cited

U.S. PATENT DOCUMENTS 3,948,721 A 4/1976 Winheim (Continued)

FOREIGN PATENT DOCUMENTS

DE 37 41 680 A1 6/1989

(Continued)

OTHER PUBLICATIONS

Search Report issued in Finnish Priority Application No. 20002592.

(Continued)

*Primary Examiner*—S. Gravini
(74) *Attorney, Agent, or Firm*—Stiennon & Stiennon

(57) ABSTRACT

The narrow-scale moisture profile of a paper web is controlled by profiling nozzles (11) of a profiling device (10) which cover part of the width of the web and desired variations of the moisture profile are corrected by the profiling nozzles (11). Coating quantity profile of a paper web may also be controlled. The narrow-scale coating quantity profile is controlled by profiling nozzles (11) of a profiling device (10) which cover part of the width of the web and desired variations of the coating quantity profile are corrected by the profiling nozzles (11). The device (10) for controlling the moisture profile or the coating quantity profile of a paper web has profiling nozzles (11) for controlling narrow-scale moisture profile variation, which cover a desired part of the width of the web, to correct desired variations occurring in the profile in the width direction of the web.

19 Claims, 4 Drawing Sheets

U.S. PATENT DOCUMENTS

| | | | | | |
|---|---|---|---|---|---|
| 4,498,248 | A | * | 2/1985 | Pabst | 34/89 |
| 4,798,110 | A | | 1/1989 | Tokuno et al. | |
| 4,996,782 | A | * | 3/1991 | Eivola | 34/114 |
| 5,286,348 | A | | 2/1994 | Perin | |
| 5,377,428 | A | * | 1/1995 | Clark | 34/446 |
| 5,557,860 | A | | 9/1996 | Kotitschke et al. | |
| 5,619,808 | A | * | 4/1997 | Pabst | 34/640 |
| 5,625,962 | A | * | 5/1997 | Fleissner | 34/446 |
| 5,685,955 | A | | 11/1997 | Leigraf et al. | |
| 5,728,930 | A | * | 3/1998 | Virta | 73/38 |
| 5,881,476 | A | * | 3/1999 | Strobush et al. | 34/451 |
| 5,933,977 | A | | 8/1999 | Deshpande et al. | |
| 6,006,443 | A | | 12/1999 | Karvinen | |
| 6,490,813 | B1 | | 12/2002 | Oechsle | |

FOREIGN PATENT DOCUMENTS

| | | |
|---|---|---|
| EP | 1 020 559 A2 | 7/2000 |
| FI | 793920 | 9/1985 |
| GB | 2 039 014 A | 7/1980 |
| GB | 1 585 846 | 3/1981 |
| WO | WO 02/42555 A1 | 5/2002 |

OTHER PUBLICATIONS

International Search Report issued in International Patent Application No. PCT/FI01/01014.

International Preliminary Examination Report issued in International Patent Application No. PCT/FI01/01014.

* cited by examiner

METHOD AND DEVICE FOR CONTROLLING THE MOISTURE OR COATING QUANTITY PROFILE IN A PAPER WEB

CROSS REFERENCES TO RELATED APPLICATIONS

This application is a U.S. national stage application of International Application No. PCT/FI01/01014, filed Nov. 22, 2001, and claims priority on Finnish Application No. 20002592, filed Nov. 24, 2000, the disclosure of each application being hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In paper machine concepts, the on-line process is becoming increasingly more important both in new machines and when old paper machines are modified. In on-line finishing, in particular in on-line multi-nip calendering of demanding grades, totally new demands are set for the profiles of paper, in particular for moisture and tension profiles, especially in connection with small-scale control of the moisture and tension profiles. New profile control methods are needed for these in order that the quality of paper and runnability should be on a satisfactory level, for example, in multi-nip calendering. In this respect, it is particularly difficult to control the narrow-scale moisture profile, for which no technically advantageous or economical methods are known in the state of the art. The narrow-scale variations of the moisture profile occurring in wide machines are particularly problematic.

Narrow-scale profile variations are either stationary or momentarily wandering in the width direction of the web. Narrow-scale variations are caused, for example, by the condition of a press felt, which may become striped upon ageing, and by colour stripes on a cylinder surface in a dryer section. In addition, basis weight variations may cause narrow-scale moisture profile variation. Distinguishing between wide-scale and narrow-scale profile variation is, of course, a relative conception and varies with different paper grades; in the manufacture of board, a profile variation of, for example, 100 mm may be regarded as narrow and that of 300 mm as wide, in the manufacture of printing paper, a profile variation of, for example, 50 mm may in turn be regarded as narrow and that of 150 mm as wide, and in the case of sanitary tissues, a profile variation of, for example, 25 mm may be regarded as narrow and that of 75 mm as wide. In this description, by narrow-scale profile variation is primarily meant a profile variation of less than 100 mm, even less than 25 mm in width, and in the profiling of the coating quantity, a profile variation of even less than 10 mm in width.

In the prior art, various arrangements are known for controlling the moisture profile of paper, but these are applicable to profiling of the entire area across the width of the web and to wide-scale control of the moisture profile of the paper web. In the prior art, a moisturizing beam is known in which regulating nozzles are used and by means of which the wide-scale variation of the moisture profile of the paper web in the width direction thereof is controlled. With respect to the prior art relating to moisturizing of the web, reference is made to U.S. Pat. Nos. 3,948,721 and 5,286,348.

The narrow-scale variations of the moisture profile cannot be controlled by the methods known in the state of the art, for example, by means of a moisturizing beam, a steam box, an infrared device, a headbox, a deflection-compensated roll, because their profiling width is too great to control narrow-scale moisture profile variation. In addition, they are suitable for use primarily across the entire width of the web.

As known from the prior art, attempts have also been made to control the problems described above such that the paper web has been overdried, thereby eliminating the narrow-scale peaks occurring in moisture profile variation. This is very costly, because it has not been possible, for example, to directly calender the overdried web but it has been necessary to re-moisturize the web by a plane moisturizer before calendering, It shall be noted in particular that it is difficult to remove moisture at the final stage of drying, overdrying thus being rather expensive and difficult to accomplish.

One problem area in the state of the art has also been the profiling of the coating quantity, the local increase of which has presented a particular problem. As known in the state of the art, it has been possible to locally reduce the quantity of coating, for example, by changing the rod or blade load.

SUMMARY OF THE INVENTION

An object of the invention is to provide a method and a device which, when used, make it possible to solve the above-noted drawbacks and problems known in the state of the art.

A particular object of the invention is thus to create a method and a device by which it is possible to control the narrow-scale moisture profile of paper.

An object of the invention is also to provide a method and a device which are suitable for control of the moisture profile in part of the area of a web in the width direction thereof.

A further object of the invention is to create a method and a device which allow the quantity of coating to be profiled.

In accordance with the invention, part of the width of the web is covered with movable profiling devices, thereby providing a profiling arrangement which treats part of the width of the web and in which the variations, i.e. peaks, caused by the narrow-scale variation in the moisture profile are controlled based on measurement. In the arrangement in accordance with the invention, the narrow-scale variation of the moisture profile is controlled by means of a movable profiling element, i.e. profiling nozzle, of the profiling device such that moisture is applied to areas which are drier, thereby eliminating the undesired phenomenon which is caused by moisture streaks due to the variation of basis weight and which also gives rise to machine-direction tension variation. At the same time, it is possible to use drying profile correction to remove moist peaks. Profiling elements of the profiling device can be placed in several groups in the width direction of the web, one group for each operating zone in the width direction of the web.

The apparatus used in the invention makes it possible to profile narrow peaks and, in the invention, both drying and moisturizing spray nozzles are advantageously placed on the same guide.

In the narrow-scale moisture profile control system in accordance with the invention, only a fraction of the width of the web, for example, 10% is covered with narrow, for example, 10-millimeter-wide profiling elements, most preferably hot air or liquid nozzles. The profiling element, or the nozzle, comprises one nozzle unit or, when needed, several component nozzles substantially one after the other in the running direction of the web. The nozzles are movable in their operating zone in the cross direction of the web and, in accordance with the invention, the nozzles are moved to cover only the worst peaks, in particular the peaks which are the worst from the viewpoint of on-line calendering. Thus, for example, in a 10-meter-wide machine, it is possible to remove, for example, 100 of the worst peaks.

When desired, the invention may also be used in wider areas, but it is particularly suitable for profiling narrow moisture profile variations. The drying capacity freed by means of the invention can be used, for example, for increasing the speed of the machine, for shortening of the dryer section.

The number of the nozzles used in connection with the invention is chosen according to the profile demands of the next process stage, i.e. how bad profile peaks must be removed, and on the basis of the quality of the original moisture profile.

In connection with the invention, for example, heat radiation, hot air, steam, liquid, gas or another suitable medium is used as the profiling medium.

In accordance with the invention, the profiling members, for example, profiling hot air nozzles, are placed, for example, in connection with a reversing cylinder or roll of a single-wire draw.

In the device in accordance with the invention, the nozzles move on a guide and a feed is connected to the nozzles, and the device comprises a control arrangement and a moving mechanism, for example, a pushing means moving on a screw guide, which moving mechanism may be, for example, inside a guide beam. The device in accordance with the invention covers, for example, half i.e. 50%, or less of the width of the web with its effective area and most appropriately 5 to 30%.

One advantageous choice for the moving mechanism of the profiling nozzles is to use devices which are attached to slide guides and placed in moving zones and which are moved by means of a push-pull rod connected to a threaded rod. A profiling medium, for example, liquid or hot air is passed into the profiling nozzle through a medium duct, for example, a compressed-air hose from a common distributor pipe. The moving is accomplished, for example, such that the machine width is divided into zones of 1 to 3 meters, in the area of which zones individual nozzles move. This arrangement allows the length of the medium ducts leading from the distributor pipe to the nozzles to be limited so that it is reasonable. In connection with the invention it is also possible to use other types of moving mechanisms and moving devices.

The nozzles are thus advantageously moved by a pushing means connected to a rotatable threaded rod, which pushing means goes and pushes nozzles to locations indicated by profile measurement data according to where in the width direction of the web the worst peaks are situated. The pushing means is controlled such that it knows the positions of the nozzles based on counting of the turns of the threaded rod, in which connection, when a new peak has appeared in the profile, the pushing means thus re-arranges the nozzles. The nozzles and their auxiliary devices are placed, for example, beneath two successive reversing rolls in a single-wire draw, for example, beneath rolls of the type registered by Metso Paper, Inc. under the trademark VacRoll, such that profile errors wider than the width of a single nozzle can also be profiled with a uniform response.

When desired, the nozzles can also be provided with control valves, in which case level adjustment can be carried out according to each individual nozzle. This is, however, not necessary because the profile can also be substantially improved by on-off valves in any case. In that connection, adjustment is carried out by adjusting the level of the trunk duct.

The arrangement in accordance with the invention provides many significant benefits: Active correction of the moisture profile with a large number of peaks is achieved while, at the same time, the average solids content is increased, thereby providing more capacity. Furthermore, the invention makes it possible to reduce the need for overdrying arising from profiles, whereby more capacity is obtained directly. In accordance with an advantageous feature, the invention does not require very large trunk air ducts, for example, of the size range of $\phi$200 to 600 nmm. In addition, the structure in accordance with the invention can be accomplished advantageously because the nozzles can be manufactured, for example, as simple sheet metal work.

The machine automation needed in connection with the invention is simple since the nozzles placed on the guide are moved, in accordance with an advantageous application, by a pushing means connected to a turn-controlled threaded rod, in which connection the control system knows the position of each nozzle.

The control automatics and electronics of the system are most appropriately placed in their entirety outside the machine hood at a location where the conditions are advantageous. Thus, the system can be very advantageously added afterwards to any machine.

Moreover, updating of the system is inexpensive and easy because, when needed, new nozzles, for example, of a different width or more nozzles are just placed on the guide and the control program is changed.

In the control system of the moisture profile of paper in accordance with the invention, a simple mechanism is adjusted, controlled and used, thereby enabling a desired part of the width of the web to be profiled.

The control system in accordance with the invention can also be used for profiling of coating.

In connection with the method in accordance with the invention, Non-Scan measurement is used particularly advantageously, said measurement using a high-resolution measuring beam which measures all the time across the entire width of the web. Advantageously, it is also possible to use measurement of the Mini-Scan type, which uses a full-width measuring beam which oscillates at an amplitude of, for example, 100 mm, thus, most appropriately with the same spacing as there are sensors in the beam, which is a quicker measuring means than a measuring device of one sensor traversing across the entire web. In the arrangement in accordance with the invention, measurement is arranged after a press and after a dryer section as profile measurement to provide a control signal for a profile actuator. When desired, it is also possible to use measurement after a calender, but this is not necessary.

BRIEF DESCRIPTION OF THE DRAWINGS

In the following, the invention will be described in greater detail with reference to the figures of the appended drawings.

DESCRIPTION OF THE PREFERRED EMBODIMENTS

Figure 1:
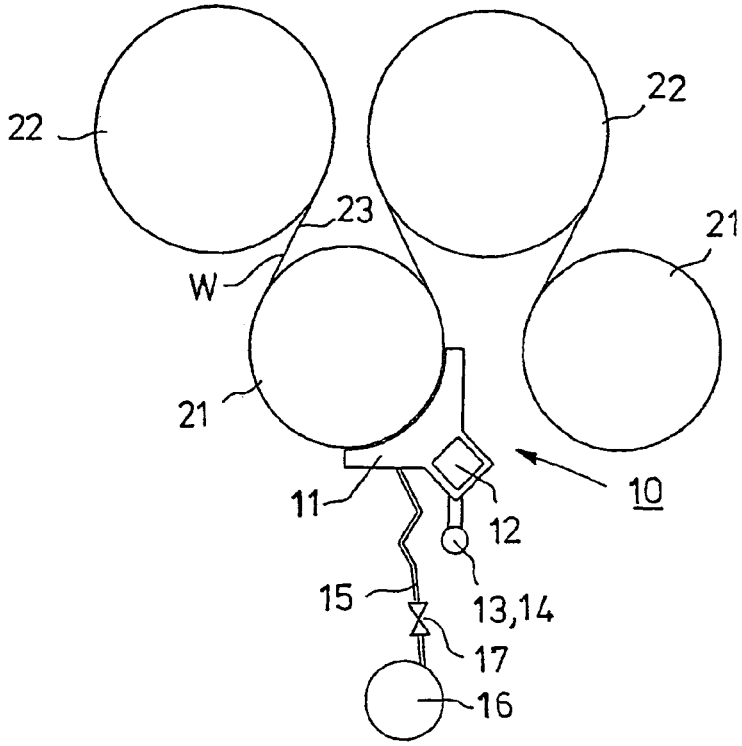
FIG. 1 is a schematic view of an exemplifying embodiment of the placement of profiling hot air nozzles.

As shown in FIG. 1, a profiling device 10 in accordance with the invention is placed in connection with a reversing cylinder or roll 21 of a single wire draw and in the figure a paper web W runs while supported by a wire 23 along a meandering path from drying cylinders 22 of an upper row to the reversing rolls 21 of a lower row. The profiling device 10 can also be placed at another suitable location in a dryer section or, when profiling the quantity of coating, before or after a coating device at an appropriate location, for example, on the surface of the web before the coating device or on the surface of the roll of the coating device or on the surface of the web. In the device 10 in accordance with the invention, profiling nozzles 11 move on a slide guide 12 and, based on counting the turns of a threaded rod 13, a pushing means 14 knows the positions of the nozzles 11. The profiling nozzle, or the profiling element 11, may be formed of one unit or of several component nozzles situated substantially one after the other in the running direction of the web. Hot air or another profiling medium is passed into the profiling nozzles 11 through a medium duct, for example, a compression air hose 15, from a common distributor pipe 16. The reference numeral 17 designates a control member, for example, a valve of the medium duct 15. The nozzles 11 can also be moved by another suitable means and their position can also be monitored by another method suitable for the purpose. The nozzles 11 are moved to cover the worst peaks of narrow-scale profile variation based on the profile data obtained from a measuring device (not shown).

Figure 2:
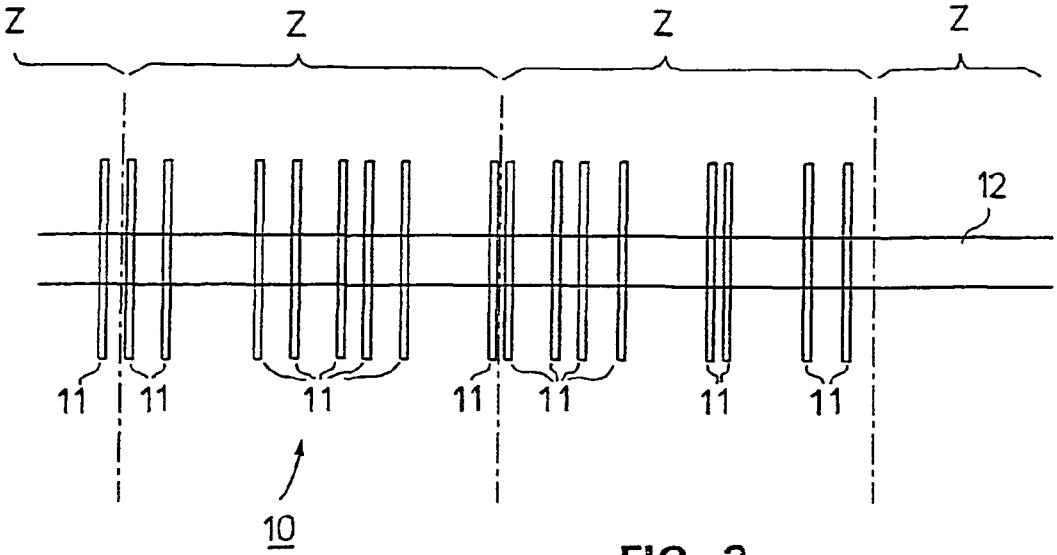
FIG. 2 schematically shows the moving of profiling nozzles in moving zones.

As shown in FIG. 2, the profile actuators 10 are placed in moving zones Z, a desired number of profiling nozzles 11, for example, 1 to 100 nozzles, most appropriately 5 to 30 nozzles, being placed in each moving zone Z, and the width of each moving zone Z being 0.5 to 5 m, most appropriately 1 to 3 m, depending on the width of the machine. In each zone, the nozzles 11 of the profile actuator 10 are moved so that they are at the worst peaks occurring in the moisture profile. The nozzles 11 can be either drying or moisturizing. In profiling the quantity of coating, the nozzles 11 apply an additional amount of coating to the surface of the web at the peaks found in narrow-scale profile variation and indicating too small a quantity of coating.

Figure 3:
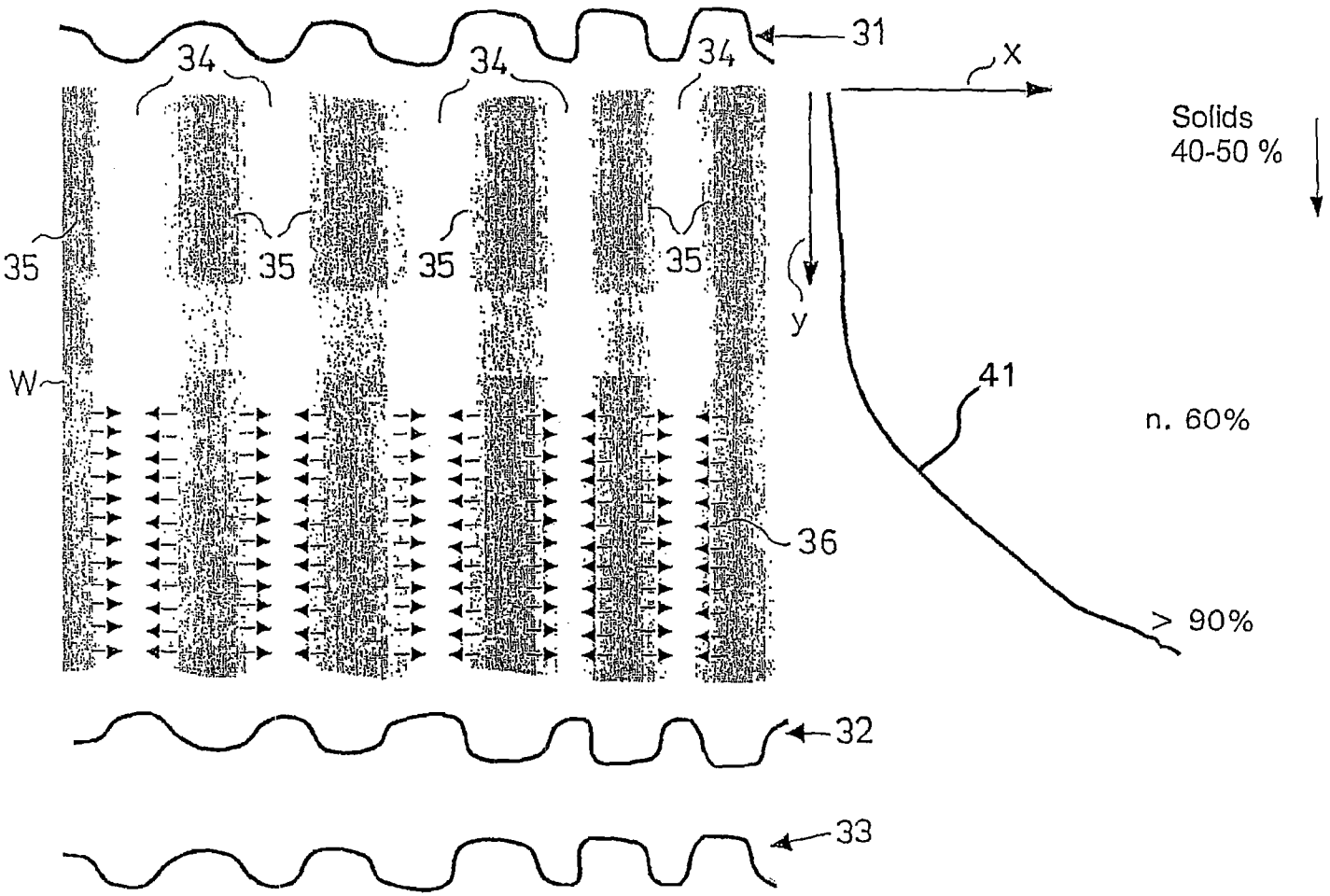
FIG. 3 schematically shows the connection between moisture, tension and basis weight profiles.

FIG. 3 shows the connection between moisture, tension and basis weight profiles. The X-axis represents shrinkage and the Y-axis represents solids content and, at the same time, the behaviour of the web in the longitudinal direction shown in the adjacent figure. The moisture profile curve is denoted with the reference numeral 31, the basis weight profile is denoted with the reference numeral 32, and the tension profile is denoted with the reference numeral 33. When the solids content of paper increases, as shown with the curve 41, dry streaks 34 in the web W start to shrink first and more quickly than moister streaks 35. The more plastic moist streaks 35 undergo permanent deformations. The web W contracts locally according to the moisture streaks 35 due to the variation of the basis weight profile 32 and, at the same time, the plastic properties of the web are concentrated unevenly in accordance with the original moisture profile 31. With the progress of local shrinkage, the tension profile 33 is formed which remains in the paper web W when elongations are frozen at the end of drying. The curve 41 illustrates the shrinkage behaviour of the web W as a function of solids, and the solids content is 40 to 50% in the initial situation, about 60 % when shrinkage begins, and over 90% at the end. The arrows 36 show straining of the web W and its cross-direction stresses.

Figure 4:
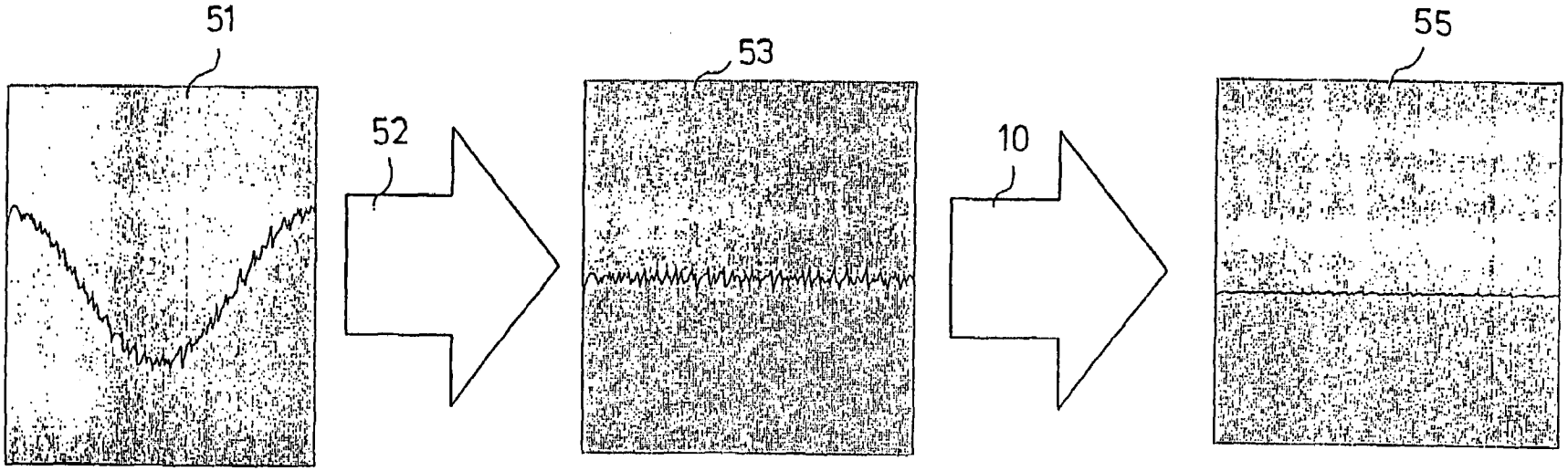
FIG. 4 schematically shows two-stage correction of the moisture profile.

As shown in FIG. 4, in two-stage correction of the moisture profile, a press moisture profile 51 coming from the press comprises large-scale and narrow-scale profile variation. First a steam box 52 or another appropriate prior-art method is used for profiling, thereby bringing the large-scale profile variation under control, and after that in a press moisture profile 53 there is narrow-scale moisture profile variation which has peaks which, in accordance with the invention, are profiled by the moisture profiling device 10, for example, hot air nozzles 11 of the impingement hood type (FIGS. 1 & 2), whereby the moisture profile can be levelled into a moisture profile 55 having a desired uniformity.

Figure 5:
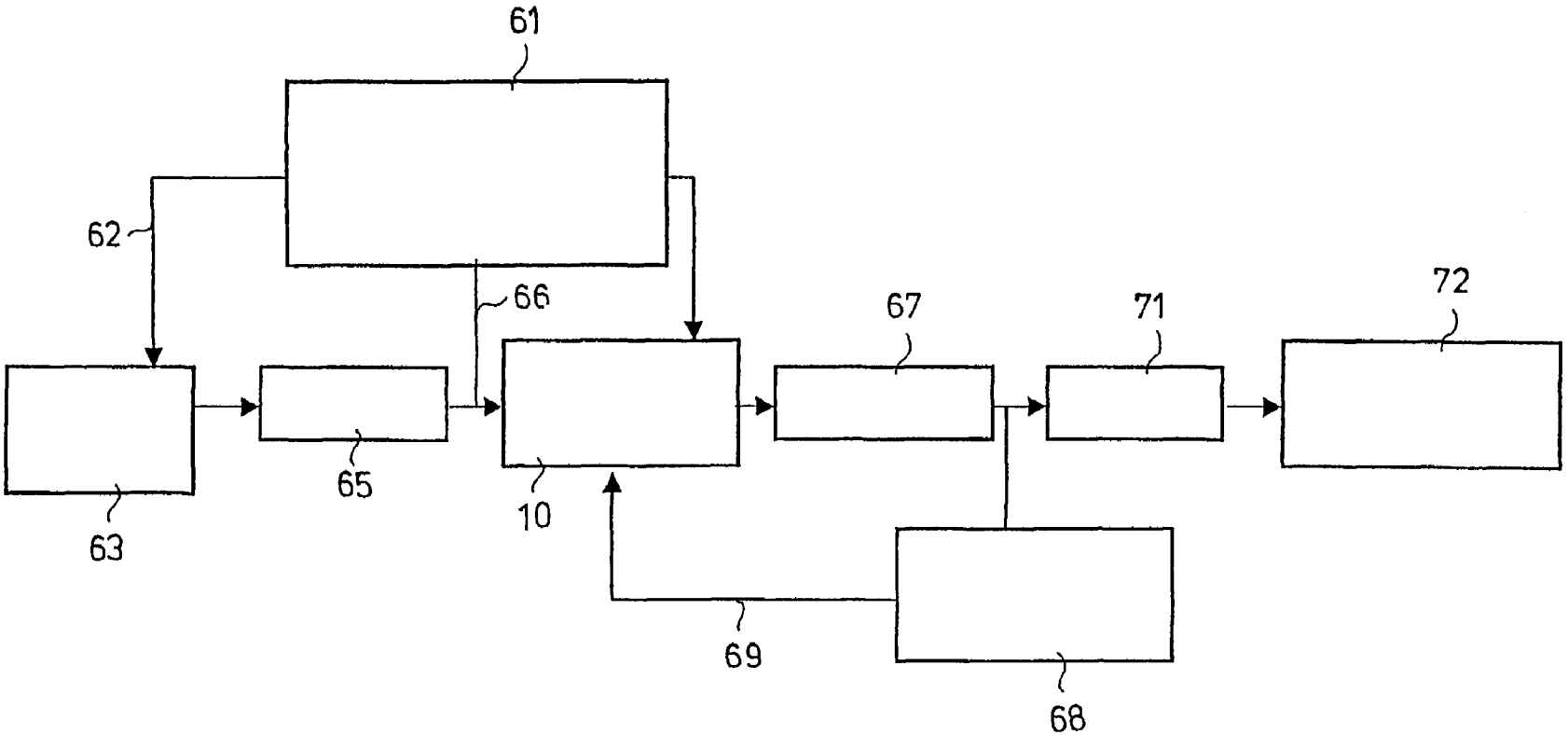
FIG. 5 shows a control system of profile actuators.

In the schematic control system chart shown in FIG. 5, a measurement device 61 has feedback 62 to a steam box 63 and feedforward to a profile actuator 10. The steam box 63 is placed on a press 65, and a measurement 66 is carried out after the press 65, said data being also transmitted to the profiling device 10. After that, the web is dried in a drying stage 67, after which a traversing measurement is carried out by a measuring device 68, which also has feedback 69 to the profile actuator 10 to control it such that narrow-scale profile variation can be eliminated. After that, the web can be calendered in a calender 71, which may be followed, when desired, by a new traversing measurement by a measuring device 72.

Above, the invention has been described with reference to some of its advantageous exemplifying embodiments only, to the details of which the invention is, however, not by any means intended to be narrowly confined.

The invention claimed is:

1. A method for controlling the coating quantity profile of a paper web wherein the paper web defines a width in a cross direction, and has a narrow-scale coating quantity profile extending over less than 100 mm in the cross direction, the method comprising the steps of:

coating the paper web with a coater;

after the coater measuring narrow scale coating quantity variations in the paper web to determine a narrow-scale coating quantity of a plurality of narrow strips, each of the narrow strips having a width of less than 100 mm in the cross direction, and having a cross direction position;

wherein the plurality of narrow strips have a cross direction sum of said widths amounting to no more than 50% of the paper web width; and controlling the narrow-scale coating quantity profile of the web by controlling the coating of each of said plurality of narrow strips before said dryer by moving one of a plurality of coating nozzles to the cross direction position corresponding to each narrow strip, and discharging a coating from the profiling nozzles on to the web to adjust each of said plurality of narrow strips to a selected coating quantity.

2. The method of claim 1 wherein the web is divided into a plurality of zones in the cross direction of the web, and each profiling nozzle is only moved within one of said zones.

3. The method of claim 1 wherein the coating quantity profile variations are controlled over at least 5% of the entire width of the web.

4. The method of claim 1 wherein the step of measuring narrow scale coating quantity variations in the paper web comprises measuring coating quantity variations of less than 10 mm.

5. A method in a papermaking machine for on-line control of the moisture profile of a paper web, in two stages, wherein the paper web defines a width in a cross direction, and has a wide-scale moisture profile extending over more than 100 mm in the cross direction and a narrow-scale moisture profile extending over less than 100 mm in the cross direction, the method comprising the steps of:

measuring the wide-scale cross direction moisture profile of the paper web after pressing the paper web in a press;

controlling the wide-scale moisture profile of the paper web moisture profile before the press to control cross direction moisture profile variations across the entire web with control devices affecting more than 100 mm of the web at a time in the cross direction;

measuring narrow scale variations in web moisture profile in the cross direction of the paper web after drying the web with a dryer to determine a moisture content of a plurality of narrow strips, each narrow strip having a width of less than 100 mm in the cross direction, and having a cross direction position;

wherein the plurality of narrow strips have a cross direction sum of said widths amounting to no more than 50% of the paper web width; and controlling the narrow-scale moisture profile of the web by controlling the moisture content of each of said plurality of narrow strips before said dryer by moving one of a plurality of profiling nozzles to the cross direction position corresponding to each narrow strip; and discharging a medium from the plurality of profiling nozzles on to the web to adjust each of said plurality of narrow strips to a selected moisture content.

6. The method of claim 5 wherein the web is divided into a plurality of zones in the cross direction of the web, and each profiling nozzle moves only within one of said zones.

7. The method of claim 5 wherein the cross direction sum of said widths is 5 to 50% of the entire width of the web.

8. The method of claim 5 wherein the measured narrow scale variations in web moisture determine the moisture content of the plurality of narrow strips and wherein each of the plurality of narrow strips has a width of less than 25 mm in the cross direction.

9. The method of claim 5 wherein the measured narrow scale variations in web moisture determine the moisture content of the plurality of narrow strips and wherein each of the plurality of narrow strips has a width of less than 10 mm in the cross direction.

10. The method of claim 5 wherein when one of the said plurality of narrow strips is too dry, discharging liquid is discharged by one of said plurality of profiling nozzles, and when one of said plurality of narrow strips is too moist, drying is effected by discharging hot air with one of said plurality of profiling nozzles.

11. A method in a papermaking machine for on-line control of the moisture profile of a paper web, wherein the paper web defines a width in a cross direction, and has a narrow-scale moisture profile extending over less than 100 mm in the cross direction, the method comprising the steps of:

measuring narrow scale variations in web moisture profile in the cross direction of the paper web after drying the web with a dryer to determine a moisture content of a plurality of narrow strips, each narrow strip having a width of less than 100 mm in the cross direction, and having a cross direction position;

wherein the plurality of narrow strips has a cross direction sum of said widths amounting to at least 5% and no more than 50% of the paper width;

controlling the narrow-scale moisture profile of the web by controlling the moisture content of each of said plurality of narrow strips before said dryer by moving in the cross direction one of a plurality of profiling nozzles to the cross direction position corresponding to each narrow strip of the plurality of narrow strips; and discharging a medium from each profiling nozzle of the plurality of profiling nozzles on to each of the plurality of narrow strips to adjust each of said plurality of narrow strips to a selected moisture content.

12. The method of claim 11 wherein the web is divided into a plurality of zones in the cross direction of the web, and each profiling nozzle is moved only within one of said plurality of zones.

13. The method of claim 11 wherein each profiling nozzle is moved on a slide guide by a pushing means mounted to a rotating rod and each profiling nozzle's position is determined by counting turns of the threaded rod.

14. A paper machine having devices for controlling moisture in a strip of a web, which strip is less than 100 mm wide in a cross direction of the paper web, the paper machine comprising:

a measurement device arranged to measure narrow scale moisture variations in the paper web to form a cross direction moisture profile;

means connected in data receiving relation to the measurement device for identifying a plurality of strips of selected moisturecontent and of less than 100 mm width in the cross direction, and for identifying for each strip a cross direction position;

a plurality of profiling nozzles positioned downstream in a machine direction from the measurement device, and mounted for independent movement in the cross direction, each nozzle arranged to effect the moisture of the web over a width of less than 100 mm, and defining an effective nozzle width, wherein a sum of the nozzles times the effective nozzle width of each nozzle is less than 50% of the width of the paper web and at least 5% of the paper web width; and means connected to the plurality of profiling nozzles for adjusting the cross-machine position thereof to correspond to the cross direction position identified for each strip.

15. The paper machine of claim 14 further comprising a means for passing a profiling medium into the plurality of profiling nozzles.

16. The paper machine of claim 14 wherein the plurality of profiling nozzles are placed in connection with a reversing cylinder or roll of a single-wire draw in a dryer section to control the moisture profile.

17. The paper machine of claim 14 wherein the means connected to the profiling nozzles for adjusting the cross-machine position thereof comprises a pushing means connected to a threaded rod and wherein the plurality of profiling nozzles are movably attached to slide guides.

18. The paper machine of claim 14 wherein the each of the plurality of profiling nozzles is provided with a regulating member to regulate the degree of profiling.

19. A paper machine having devices for controlling coating quantity in a strip of a web, which strip is less than 100 mm wide in the cross direction of the paper web, the paper machine comprising:

a coater arranged to apply coating to the paper web;

a measurement device position downstream in a machine direction from the coater, and positioned to measure narrow scale coating quantity profile in the paper web to form a cross direction coating quantity profile;

means connected in data receiving relation to the measurement device for identifying a plurality of strips of selected coating quantity of less than 100 mm width in the cross direction, and for identifying for each strip a cross direction position;

a plurality of profiling nozzles downstream of the measurement device, and mounted for independent movement in the cross direction, wherein each nozzle is connected to a supply of coating and arranged to effect the coating quantity profile of the web over a width of less than 100 mm, and defining an effective nozzle width, wherein a sum of the nozzles times the effective nozzle width of each nozzle is less than 50% of the width of the paper web and at least 5% of the paper web width; and means connected to the plurality of profiling nozzles to adjust the cross-machine position thereof to correspond to the cross direction position identified for each strip.

* * * * *